US006352136B1

(12) United States Patent
Shih

(10) Patent No.: US 6,352,136 B1
(45) Date of Patent: Mar. 5, 2002

(54) AUXILIARY SAFETY LIFT DEVICE FOR ELEVATOR

(76) Inventor: Kuei-Tang Shih, No. 46, Nong 12, Lane 108, Yong-Feng Rd., Tai-Ping Hsiang, Taichung Hsien (TW)

( * ) Notice: Subject to any disclaimer, the term of this patent is extended or adjusted under 35 U.S.C. 154(b) by 37 days.

(21) Appl. No.: 09/596,691

(22) Filed: Jun. 19, 2000

(51) Int. Cl.[7] ..... B66B 9/02
(52) U.S. Cl. ..... 187/250; 187/290; 254/340
(58) Field of Search ..... 187/250, 289, 187/290, 414; 254/340

(56) References Cited

U.S. PATENT DOCUMENTS

| | | | | |
|---|---|---|---|---|
| 3,477,695 A | * | 11/1969 | Noly | 254/150 |
| 3,559,768 A | * | 2/1971 | Cox | 187/94 |
| 4,220,222 A | * | 9/1980 | Kamaike et al. | 187/29 R |
| 6,020,657 A | * | 2/2000 | Liran | 307/64 |
| 6,094,024 A | * | 7/2000 | Westlake | 318/375 |
| 6,182,945 B1 | * | 2/2001 | Dyer et al. | 254/340 |

* cited by examiner

*Primary Examiner*—Thomas J. Brahan
(74) *Attorney, Agent, or Firm*—Charles E. Baxley

(57) ABSTRACT

An auxiliary safety lift device for an elevator includes a main elevator power system, a spare electric power system, a secondary motor, a secondary speed reducer, and an electromagnetic clutch. The electromagnetic clutch includes an electromagnetic disk, a transmission disk for rotating the main shaft of the main motor of the main elevator power system, a drive disk rotated by the secondary speed reducer, and a spring sheet secured on the drive disk. When the electromagnetic disk is energized by the spare electric system, the spring sheet is attracted by the electromagnetic disk to engage the transmission disk so that the transmission disk is rotated with the drive disk to rotate the main shaft of the main motor. Accordingly, when the power of the main elevator power system is cutoff, the spare electric power system is started to drive the secondary motor to drive the secondary speed reducer which co-operates with the electromagnetic clutch to rotate the main shaft of the main motor to drive the main speed reducer of the main elevator system for lifting the elevator.

5 Claims, 4 Drawing Sheets

AUXILIARY SAFETY LIFT DEVICE FOR ELEVATOR

BACKGROUND OF THE INVENTION

1. Field of the Invention

The present invention relates to an auxiliary safety lift device, and more particularly to an auxiliary safety lift device for an elevator.

2. Description of the Related Art

A conventional safety device for an elevator in accordance with the prior art shown in FIG. 1 comprises a brake 12 secured on one side of the main motor 11 of the elevator. When the electric power of the elevator is cutoff or when the control system of the elevator fails, the brake 12 will detect the cutoff of the electric power and will automatically lock the differential 13 and the cable 14 of the elevator, thereby preventing the elevator from falling down.

The conventional safety device also comprises a press button which is connected to that of the alarm bell of the guard of the building so that when a person is in the cab of the elevator, the user may inform the guard of the accident.

However, when the elevator is stopped, the user in the cab of the elevator cannot assure the height and position of the elevator so that he cannot escape from the elevator by himself and has to stay in the cab of the elevator and wait continuously until the rescuer arrives. In such a manner, when the fire, the earthquake or the like takes place, the user limited in the cab of the elevator is easily hurt due to the accident.

In addition, when the control system of the elevator fails, the brake 12 of the conventional safety device will automatically lock the elevator for preventing the elevator from falling down so that the elevator easily stops between two adjacent floors.

However, the user limited in the cab of the elevator cannot control the position of the elevator by himself. Therefore, when the rescuer opens the door of the elevator, the user has to climb upward or downward from the elevator through a certain distance so as to reach the opening of the nearest floor, thereby easily causing danger to the user.

SUMMARY OF THE INVENTION

The present invention has arisen to mitigate and/or obviate the disadvantage of the conventional safety device for an elevator.

In accordance with one aspect of the present invention, there is provided a auxiliary safety lift device for an elevator comprising: a main elevator power system; a spare electric power system having an independent power supply; a secondary motor connected with and operated by the spare electric power system; a secondary speed reducer driven by the secondary motor; and an electromagnetic clutch.

The main elevator power system includes a main motor having a main shaft, an electromagnetic brake, and a main speed reducer.

The electromagnetic clutch includes an electromagnetic disk secured on the main motor of the main elevator power system, and connected with and driven by the spare electric power system; a transmission disk rotatably mounted on the electromagnetic disk and secured to the main shaft of the main motor of the main elevator power system for rotating the main shaft; a drive disk rotatably mounted on the secondary speed reducer and rotated by the secondary speed reducer; and a spring sheet secured on the drive disk and located adjacent to the transmission disk.

In such a manner, when the electromagnetic disk is energized by the spare electric system, the spring sheet is attracted by the electromagnetic disk to engage the transmission disk so that the transmission disk is rotated with the drive disk so as to rotate the main shaft of the main motor of the main elevator power system.

Accordingly, when the power of the main elevator power system is cutoff, the spare electric power system is started to drive the secondary motor to drive the secondary speed reducer which in turn co-operates with the electromagnetic clutch to rotate the main shaft of the main motor of the main elevator power system to drive the main speed reducer of the main elevator system for lifting the elevator.

Preferably, the auxiliary safety lift device also comprises a control system connected with the spare electric power system for controlling it.

Further benefits and advantages of the present invention will become apparent after a careful reading of the detailed description with appropriate reference to the accompanying drawings.

DETAILED DESCRIPTION OF THE INVENTION

Figure 1:
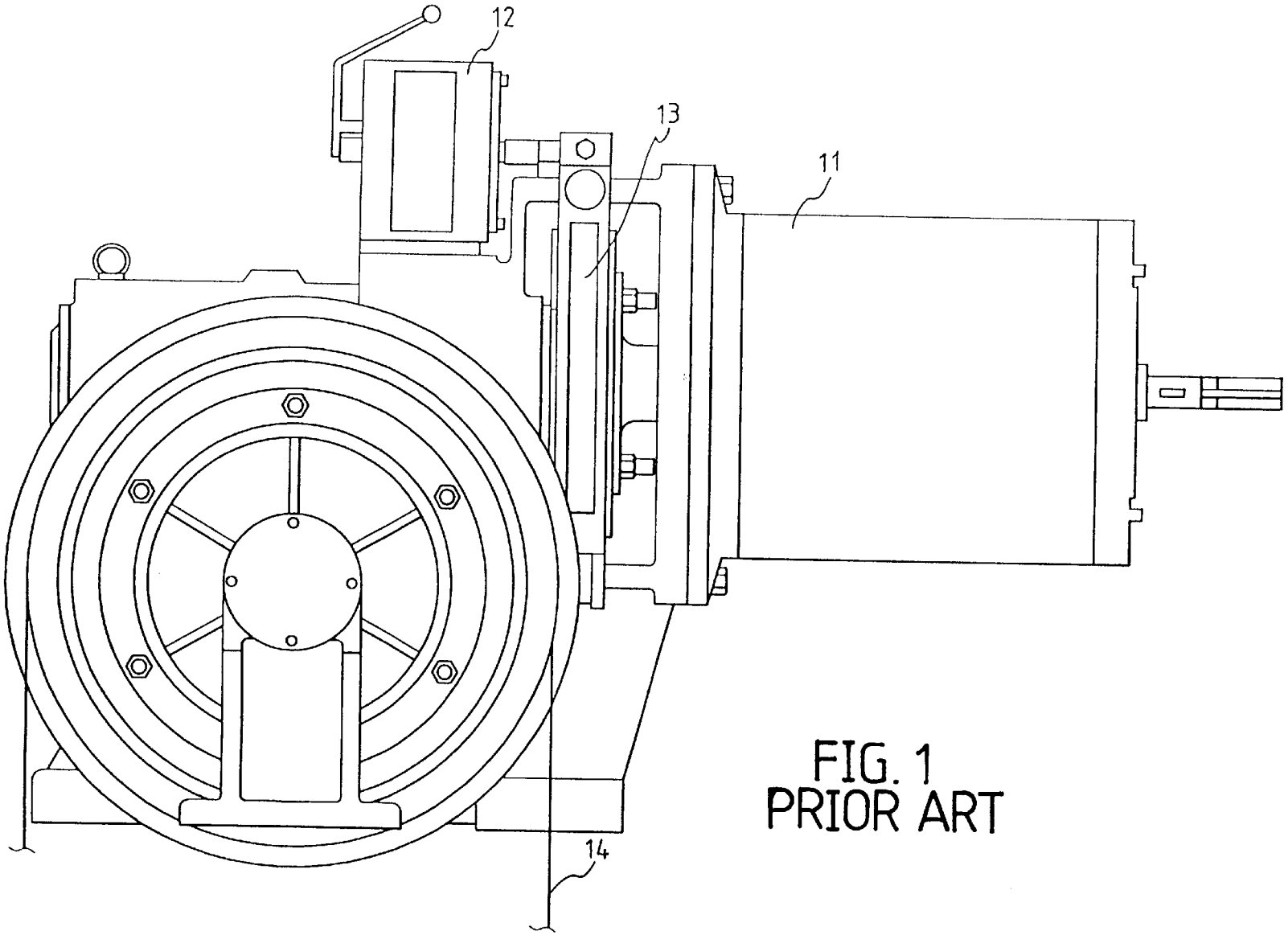
FIG. 1 PRIOR ART
FIG. 1 is a schematic view of a conventional safety device for an elevator in accordance with the prior art.
Figure 2:
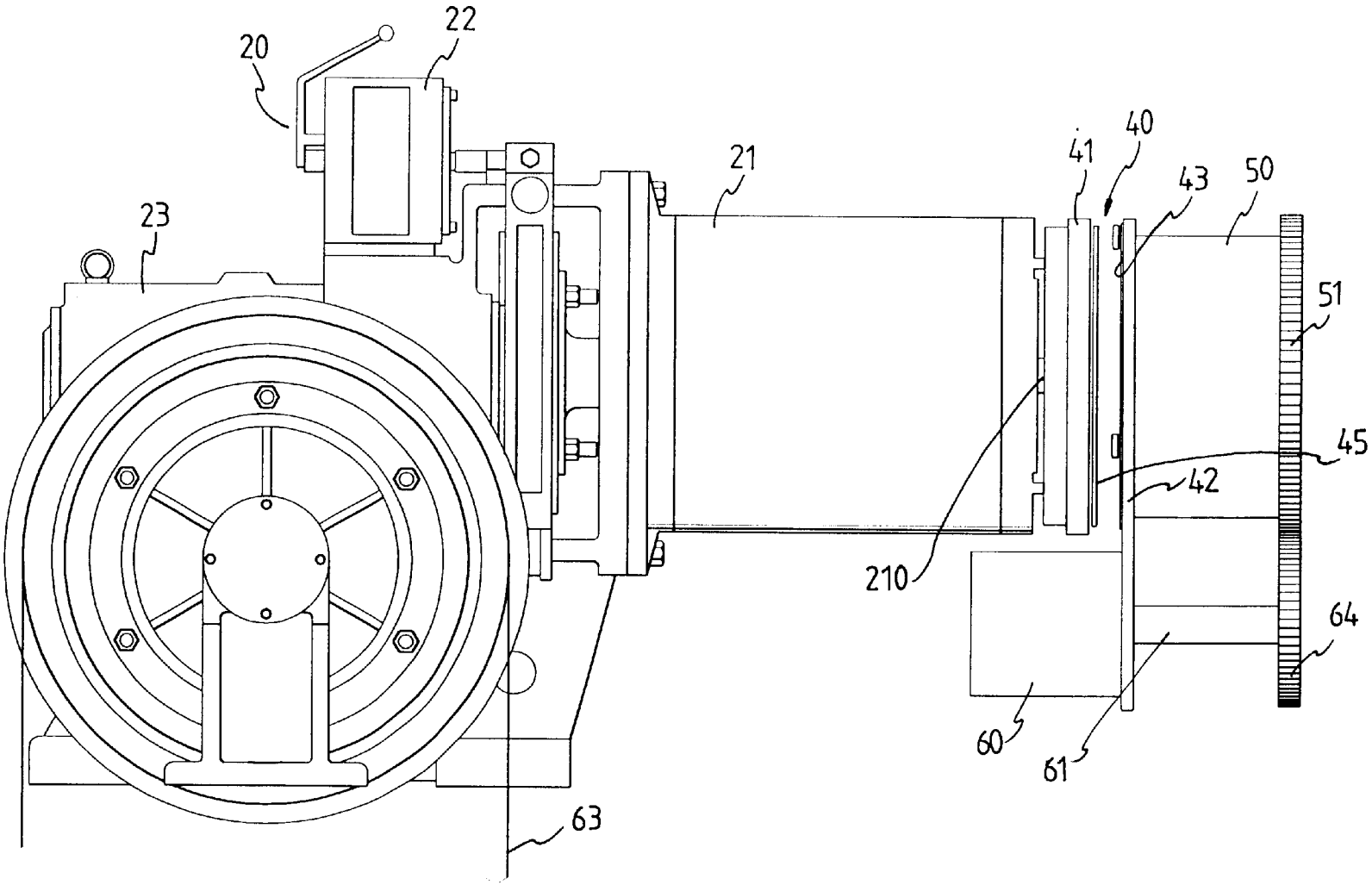
FIG. 2 is a schematic view of an auxiliary safety lift device for an elevator in accordance with the present invention.
Figure 3:
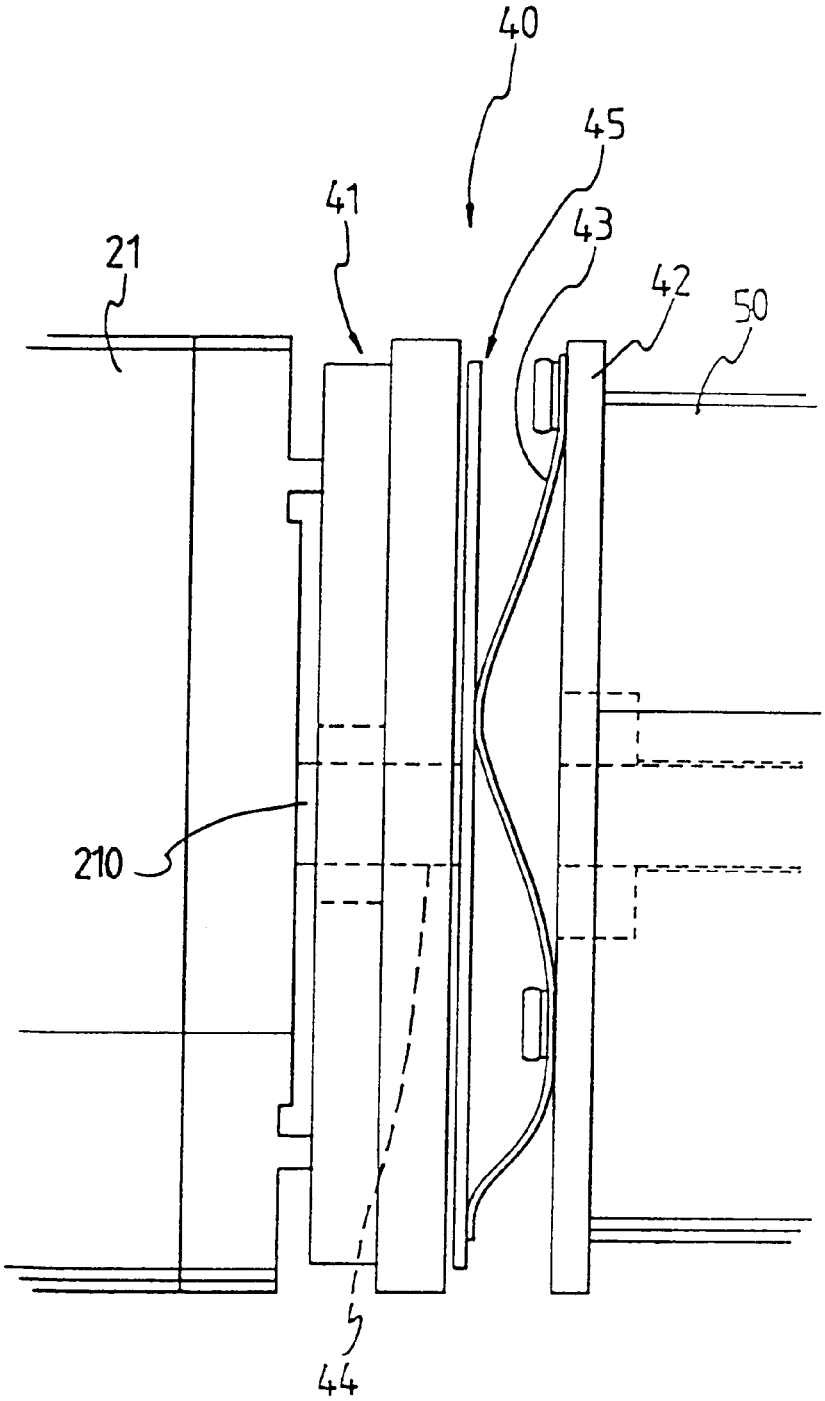
FIG. 3 is a partially enlarged operational view of the auxiliary safety lift device as shown in FIG. 2.
Figure 4:
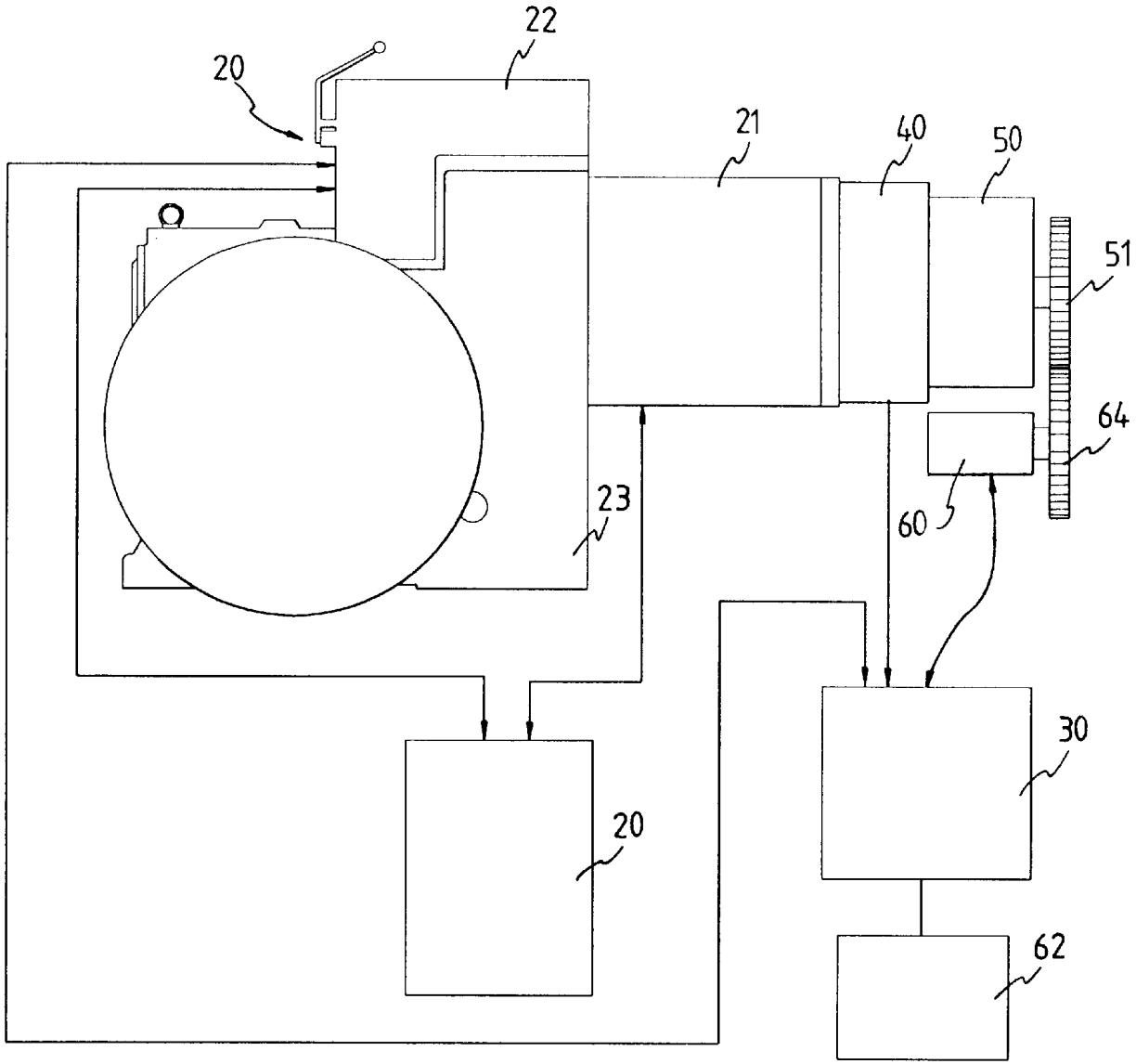
FIG. 4 is a schematic circuit diagram of the auxiliary safety lift device as shown in FIG. 2 in use.

Referring to FIGS. 2–4, an auxiliary safety lift device for an elevator in accordance with the present invention comprises a main elevator power system including a main motor 21 having a main shaft 210 rotatably mounted therein, an electromagnetic brake 22, and a main speed reducer 23; a spare electric power system 30 having an independent power supply; a secondary motor 60 connected with and operated by the spare electric power system 30; a secondary speed reducer 50 driven by the secondary motor 60; and an electromagnetic clutch 40. The auxiliary safety lift device further comprises a control system 62 connected with the spare electric power system 30 for controlling it. Preferably, the control system 62 includes a storage battery for preventing an electric cutoff.

The electromagnetic clutch 40 includes an electromagnetic disk 41 secured on the main motor 21 of the main elevator power system 20, and connected with and driven by the spare electric power system 30, a transmission disk 45 rotatably mounted on the electromagnetic disk 41 and secured to the main shaft 210 of the main motor 21 of the main elevator power system 20 for rotating the main shaft 210, a drive disk 42 rotatably mounted on the secondary speed reducer 50 and rotated by the secondary speed reducer 50, and a spring sheet 43 secured on the drive disk 42 and located adjacent to the transmission disk 45.

The electromagnetic disk 41 of the electromagnetic clutch 40 defines a through hole 44 for allowing passage of the main shaft 210 of the main motor 21 of the main elevator power system 20.

The secondary motor 60 includes a drive gear 64 rotated by the secondary motor 60, and the secondary speed reducer 50 includes a driven gear 51 meshing with and rotated by the drive gear 64 of the secondary motor 60 so that the secondary speed reducer 50 is driven by the secondary motor 60. The secondary motor 60 includes an output shaft 61 for rotating the drive gear 64.

In such a manner, when the electromagnetic disk 41 is energized by the spare electric system 30, the spring sheet 43 of the drive disk 42 is attracted by the electromagnetic disk 41 to engage the transmission disk 45 so that the transmission disk 45 is rotated with the drive disk 42 so as to rotate the main shaft 210 of the main motor 21 of the main elevator power system 20.

Accordingly, when the power of the main elevator power system 20 is cutoff, the spare electric power system 30 is started to drive the secondary motor 60 to drive the secondary speed reducer 50 which co-operates with the electromagnetic clutch 40 to rotate the main shaft 210 of the main motor 21 of the main elevator power system 20 to drive the main speed reducer 23 of the main elevator system 20 for lifting the elevator.

In operation, when the power of the main elevator power system 20 is cutoff or when the control system (not shown) of the elevator is inoperative, the main motor 21 and the main speed reducer 23 of the main elevator power system 20 will stop operating due to lost of the electricity. The electromagnetic brake 22 of the main elevator power system 20 will automatically lock the elevator when the electricity is cutoff.

At the same time, the user limited the cab of the elevator may open the control system 62 of the elevator so as to start the spare electric power system 30 so that the electric power of the spare electric power system 30 is transmitted to the electromagnetic disk 41 of the electromagnetic clutch 40, the secondary motor 60, and the electromagnetic brake 22 simultaneously.

When the electromagnetic disk 41 of the electromagnetic clutch 40 is energized by the spare electric system 30, the spring sheet 43 secured on the drive disk 42 is attracted and bent by electromagnetic attractive force of the electromagnetic disk 41 to securely bond and engage the transmission disk 45 so that the transmission disk 45 is synchronously rotated with the drive disk 42 through the spring sheet 43 so that the main shaft 210 of the main motor 21 of the main elevator power system 20 can be rotated by the secondary speed reducer 50.

When the secondary motor 60 is operated by the spare electric power system 30, the output shaft 61 is driven by the secondary motor 60 to rotate the drive gear 64 which rotates the driven gear 51 so as to transmit the power to the secondary speed reducer 50 which can be used to rotate the main shaft 210 of the main motor 21 of the main elevator power system 20 to transmit the power to the main speed reducer 23 of the main elevator power system 20 so as to pull the cable 63 for lifting the elevator.

It is appreciated that, the power supplied by the output shaft 61 of the secondary motor 60 is initially transmitted through the drive gear 64 and the driven gear 51, and is then transmitted through the secondary speed reducer 50 and the main speed reducer 23. Therefore, the power requirement for the secondary motor 60 is not very large, thereby relatively decreasing the power requirement for the spare electric system 30. Accordingly, the spare electric system 30 with a small power can be used for efficiently lifting the elevator in a safe manner.

It should be clear to those skilled in the art that further embodiments may be made without departing from the scope of the present invention.

What is claimed is:

1. An auxiliary safety lift device for an elevator comprising:

a main elevator power system (20) including a main motor (21) having a main shaft (210), an electromagnetic brake (22), and a main speed reducer (23);

a spare electric power system (30) having an independent power supply;

a secondary motor (60) connected with and operated by said spare electric power system (30);

a secondary speed reducer (50) driven by said secondary motor (60); and an electromagnetic clutch (40) including:

an electromagnetic disk (41) secured on said main motor (21) of said main elevator power system (20), and connected with and driven by said spare electric power system (30);

a transmission disk (45) rotatably mounted on said electromagnetic disk (41) and secured to said main shaft (210) of said main motor (21) of said main elevator power system (20) for rotating said main shaft (210);

a drive disk (42) rotatably mounted on said secondary speed reducer (50) and rotated by said secondary speed reducer (50); and a spring sheet (43) secured on said drive disk (42) and located adjacent to said transmission disk (45), wherein when said electromagnetic disk (41) is energized by said spare electric system (30), said spring sheet (43) is attracted by said electromagnetic disk (41) to engage said transmission disk (45) so that said transmission disk (45) is rotated with said drive disk (42) so as to rotate said main shaft (210) of said main motor (21) of said main elevator power system (20);

whereby, when the power of said main elevator power system (20) is cutoff, said spare electric power system (30) is started to drive said secondary motor (60) to drive said secondary speed reducer (50) which co-operates with said electromagnetic clutch (40) to rotate said main shaft (210) of said main motor (21) of said main elevator power system (20) to drive said main speed reducer (23) of said main elevator system (20) for lifting said elevator.

2. The auxiliary safety lift device in accordance with claim 1, wherein said electromagnetic disk (41) of said electromagnetic clutch (40) defines a through hole (44) for allowing passage of said main shaft (210) of said main motor (21) of said main elevator power system (20).

3. The auxiliary safety lift device in accordance with claim 1, further comprising a control system (62) connected with said spare electric power system (30) for controlling it.

4. The auxiliary safety lift device in accordance with claim 1, wherein said secondary motor (60) includes a drive gear (64) rotated by said secondary motor (60), and said secondary speed reducer (50) includes a driven gear (51) meshing with and rotated by said drive gear (64) of said secondary motor (60) so that said secondary speed reducer (50) is driven by said secondary motor (60).

5. The auxiliary safety lift device in accordance with claim 4, wherein said secondary motor (60) includes an output shaft (61) for rotating said drive gear (64).

* * * * *